United States Patent [19]

Toda

[11] Patent Number: 4,888,570

[45] Date of Patent: Dec. 19, 1989

[54] CIRCUIT BREAKER

[75] Inventor: Haruhisa Toda, Fukuyama, Japan

[73] Assignee: Mitsubishi Denki Kabushiki Kaisha, Tokyo, Japan

[21] Appl. No.: 195,637

[22] Filed: May 17, 1988

[30] Foreign Application Priority Data

| | | | |
|---|---|---|---|
| May 18, 1987 | [JP] | Japan | 62-75097 |
| May 18, 1987 | [JP] | Japan | 62-75108 |
| May 18, 1987 | [JP] | Japan | 62-75109 |
| May 19, 1987 | [JP] | Japan | 62-74899 |

[51] Int. Cl.[4] ..... H01H 9/20

[52] U.S. Cl. ..... 335/167; 335/172

[58] Field of Search ..... 335/166–173; 335/174, 175, 6–9, 21–25

[56] References Cited

U.S. PATENT DOCUMENTS

| | | | |
|---|---|---|---|
| 3,053,954 | 9/1962 | Jencks et al. . | |
| 3,492,690 | 1/1970 | Murai et al. . | |
| 4,622,530 | 11/1986 | Ciarcia et al. | 335/167 |
| 4,724,411 | 2/1988 | Matsumoto et al. | 335/172 |
| 4,736,174 | 4/1988 | Castonguay et al. | 335/169 |

*Primary Examiner*—Leo P. Picard
*Assistant Examiner*—Lincoln Donovan
*Attorney, Agent, or Firm*—Lowe, Price, LeBlanc, Becker & Shur

[57] ABSTRACT

In a trip relay mechanism (50) of circuit breaker wherein a latch (23A), a latch lever (25A) and a trip bar (34) are urged to engage with each other; the trip bar (34) is disposed between the latch (23A) and the latch lever (25A) in the direction of power source side-load side of the circuit breaker and they (23A, 25A, 34) are urged by one double-torsion spring (35), and further the trip bar (34) is separated into a main part (34B) extended over each pole and a latching part (34A) for engaging the latch lever (25A).

7 Claims, 12 Drawing Sheets

CIRCUIT BREAKER

FIELD OF THE INVENTION AND RELATED ART STATEMENT

1. FIELD OF THE INVENTION

The present invention relates to a circuit breaker, and more particularly to an improvement of a trip relay mechanism which transmits an operation of automatic trip device to a cradle.

2.DESCRIPTION OF THE RELATED ART

FIGS. 12–17 show a conventional circuit breaker. FIG. 12 is a front view of the circuit breaker, and FIG. 13 is a cross-sectional view taken on line XIII—XIII of FIG. 12. In these figures, a case 1 comprises a base 1a and a cover 1*b*, and therein a central pole 1A having an opening/closing mechanism and adjacent poles 1B and 1B having no opening/closing mechanism are provided. A fixed conductor 2 of power source side is fixed on the base 1*a*, and a fixed contact 3 is fixed on the fixed conductor 2. A movable conductor 7 having a movable contact 6 thereon is pivotally mounted on a second contact arm 10*b* by a first pin 11. The movable conductor 7 is connected to an automatic trip device 4 via a flexible wire 8 and a connection bar 9. The automatic trip device 4 has therein a thermal-electromagnetic mechanism (not shown) or a solid-state trip device (not shown). A fixed conductor 5 of load side is provided out of the automatic trip device 4. A contact arm 10 comprises a first contact arm 10*a* which is connected to an opening/closing operation mechanism described later and the second contact arm 10*b*. Both contact arms 10*a* and 10*b* are pivotally held by a shaft 12. The first contact arm 10*a*of each pole is linked by a crossbar 13. A J-shaped aperture 14, which is long in an opening/-closing direction of the movable contact 6, is formed on the first contact arm 10*a*, and an oblong hole 15, which is long in a crossing direction against the opening/closing direction and catches a second pin 16 together with the J-shaped aperture 14, is formed on the second contact arm 10*b*. The second pin 16 is urged by a tension spring 17 to the first pin 11. A compression spring 18 is provided between the movable conductor 7 and the second contact arm 10*b* in order to give contact pressure to the movable contact 6. Via an urge force of a tension spring 20*d*, an operation handle 19 is linked with the opening/closing operation mechanism 20 which comprises a cradle 20*a*, an upper link 20*b* and a lower link 20*c*, etc.. A stopper pin 21 is provided on the cradle 20*a*. The first contact arm 10*a* is connected with the lower link 20*c* by a connection pin 22. A trip relay mechanism 50 which comprises several mechanical parts is provided between the cradle 20*a* and a trip rod 32 of the automatic trip device 4.

FIG. 16 is an enlarged view of the trip relay mechanism 50 in FIG. 13. In FIG. 16, an engaging part 23*a* of a latch 23 is engaged with an end of the cradle 20*a* thereby to position the cradle 20*a* into a predetermined position. The latch 23 is rotatably held by a pin 24. A roller 125 which is mounted on a latch lever 25 is engaged with the latch 23 so as not to allow the latch 23 to rotated by the cradle 20*a*. The latch lever 25 is also rotably held by a pin 26. A lever 27*a* which is fixed to a trip bar 27 is engaged with a top end of the latch lever 25 so as not to allow the latch lever 25 to disengage from the latch 23 and to rotate thereby. The trip bar 27 is also rotatably held by a pin 28. By a torsion spring 29 which is mounted on the pin 24, the latch 23 and the latch lever 25 are urged in an anti-clockwise direction. The trip bar 27 is urged by a tension spring 30 under such state that the lever 27*a* of the trip bar 27 is engaged with the latch lever 25. As shown in FIG. 12, the trip bar 27 is extended over respective poles 1B, 1A and 1B and is held by a side frame 31*a* of a frame 31 fixed on the base 1*a*. The trip relay mechanism 50 (FIG. 13), which comprises the latch 23, the latch lever 25 and the trip bar 27, and the opening/closing operation mechanism 20, etc., are held by and between the two side frames 31*a* and 31*a*.

The operation of this known circuit breaker is now described. FIGS. 12, 13 and 16 show a closed state of the circuit breaker. In FIG. 13, a current flows through the fixed conductor 2 of power source side, the fixed contact 3, the movable contact 6, the movable conductor 7, the flexible wire 8, the connection bar 9, the automatic trip device 4 and the fixed conductor 5 of load side. When the operation handle 19 is moved to a direction shown by an arrow 33 thereby to open the circuit breaker, the contact arm 10 is lifted up by the opening/-closing operation mechanism, and thereby the movable contact 6 together with the movable conductor 7 are disconnected from the fixed contact 3 as shown in FIG. 14. At that time, since the second pin 16 is caught in a left end 14*a* of the J-shaped aperture 14 by receiving an urge of the tension spring 17, both the first contact arm 10*a* and the second contact arm 10*b* are pivotally lifted up by the opening/closing operation mechanism 20 around the shaft 12 until the second contact arm 10*b* collides with the stopper pin 21 and stops thereat. Under the closed state shown by FIG. 13 and an open state shown by FIG. 14, since the trip rod 32 is not projected out of the automatic trip device 4, the trip relay mechanism 50 (FIG. 13) maintains a state shown in FIG. 16, and the cradle 20*a* is latched by the latch 23.

When an overcurrent flows through the circuit breaker, the automatic trip device 4 operates and the trip rod 32 projects out of the automatic trip device 4 as shown in FIG. 17. As a result, the trip bar 27 is rotated clockwise against an urge of the tension spring 30 and the lever 27*a* is disengaged from the latch lever 25, and thereby the latch lever 25 is allowed to rotate clockwise. Then, the latch 23 is rotated clockwise by a lifting force of the cradle 20*a* against an urge of the torsion spring 29, and simultaneously the latch lever 25 is also rotated clockwise by the latch 23 against the urge of the torsion spring 29. Consequently, the trip relay mechanism 50 instantaneously gets settled in a state shown by FIG. 17 and the cradle 20*a* jumps up, to rotate anti-clockwise. By this rotation of the cradle 20*a*, the opening/closing operation mechanism 20 is operated, and thereby the contact arm 10 is lifted up thereby to disconnect the movable contact 6 from the fixed contact 3 as shown in FIG. 15. At that time, in the same way as in the open state shown by FIG. 14, since the second pin 16 is caught in the left end 14*a* of the J-shaped aperture 14 by receiving the urge of the tension spring 17, both the first contact arm 10*a* and the second contact arm 10*b* are pivotally lifted up by the opening/closing operation mechanism 20 around the shaft 12 until the second contact arm 10*b* collides with the stopper pin 21 and stops thereat. Thus, the overcurrent is interrupted and now the circuit breaker is in a trip state.

In the above-mentioned circuit breaker, the latch 23, the latch lever 25 and the trip bar 27 are disposed by a predetermined positional relationship in order to minimize a moment for disengagement of the trip bar 27, thereby to minimize a required force upon the trip rod 32 to disengage the cradle 20*a* from the latch 23. That is, in FIG. 16, predetermined intervals are required between each fulcrum and each point of application about the latch 23 and the latch lever 25, and more specifically between the engaging part 23*a* of the latch 23 and an axis of the pin 24, between the axis of the pin 24 and a contacting point 23*h*, between the contacting point 23*h* and an axis of the pin 26 and between the axis of the pin 26 and a contacting point 25*h*. To keep these intervals, the latch 23, the latch lever 25 and the trip bar 27 are disposed in this order from the power source side to the load side. Therefore, size of the circuit breaker becomes inevitably long in the direction of power source side-load side.

Further, since the trip bar 27 must be mounted in the trip relay mechanism 50 (FIG. 13) and extended over all poles of the circuit breaker as shown in FIG. 12, it is difficult to assemble the trip bar 27 into the circuit breaker.

Furthermore, since the tension spring 30 and the torsion spring 29 are required to be assembled with other elements, it takes skill and a long time for a worker to assemble the trip relay mechanism 50, and the manufacturing cost becomes high because of the large number of parts involved.

OBJECT AND SUMMARY OF THE INVENTION

The object of the present invention is to offer a circuit breaker having a shortened length in the direction of power source side - load side, wherein a trip relay mechanism is simplified and easy to assemble.

In order to achieve the above-mentioned object, a circuit breaker in accordance with the present invention comprises:

a case;

a fixed contact fixed on a part of the case;

a movable contact which is pivotally mounted on the case and is to be connected with the fixed contact;

opening/closing operation means which is pivotally mounted on the case for disconnecting/connecting the movable contact from/with the fixed contact and urged to disconnect the movable contact from the fixed contact;

a latch which is pivotally mounted from the case and urged to engage with the opening/closing operation means;

a latch lever which is pivotally mounted from the case and urged to engage with the latch;

a trip bar which is pivotally mounted from the case at a location between the latch and the latch lever in a direction of power source side - load side of the case and urged to engage with the latch lever; and an automatic trip device for causing to disengage the trip bar from the latch lever when a current of greater than a predetermined value flows, thereby to allow the movable contact to disconnect from the fixed contact.

DESCRIPTION OF THE PREFERRED EMBODIMENT

Figure 1:
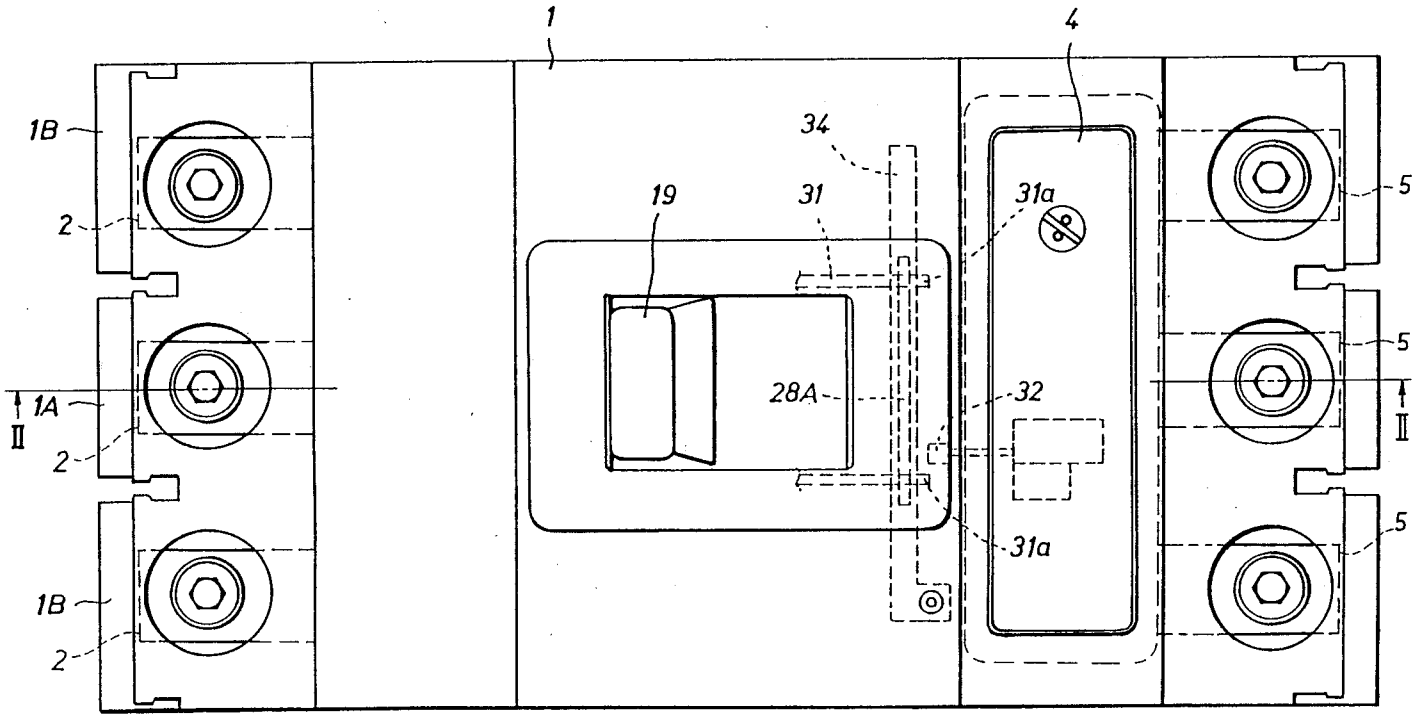
FIG. 1 is a front view showing a preferred embodiment of a circuit breaker of the present invention.
Figure 2:
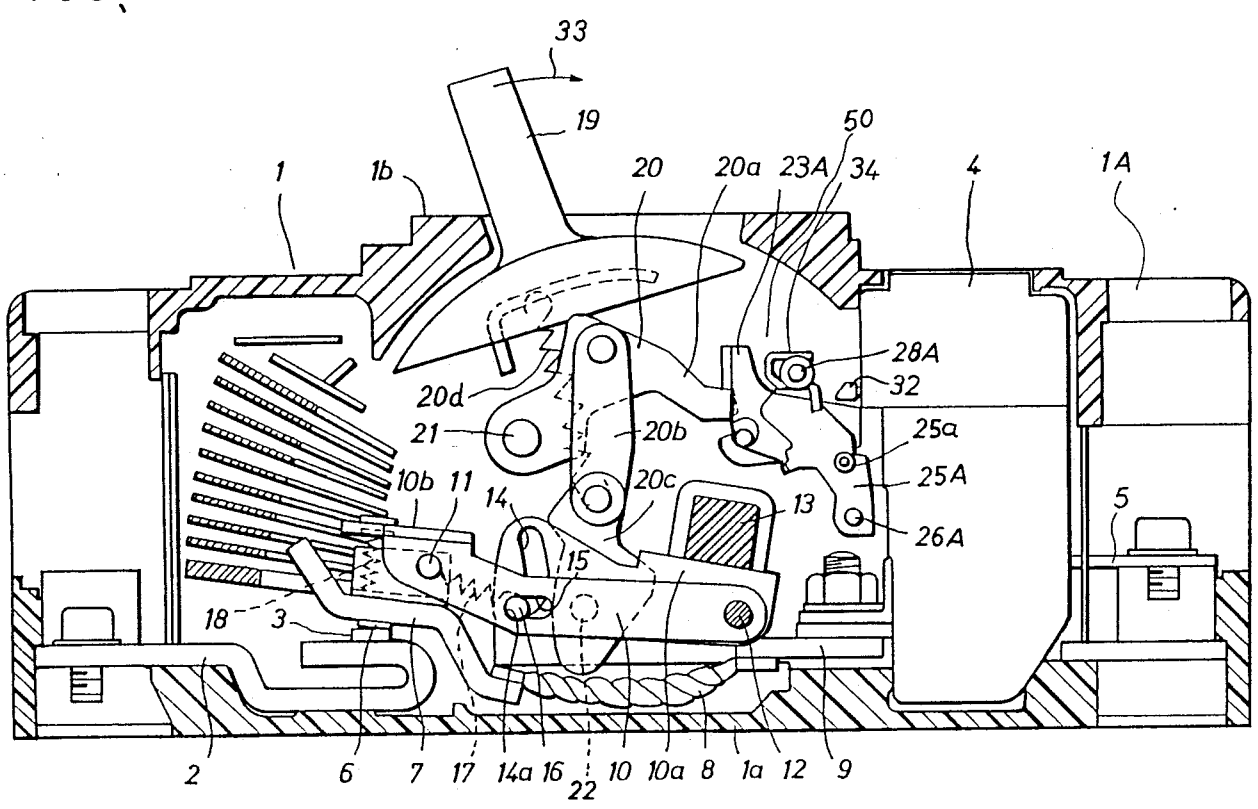
FIG. 2 is a cross-sectional view taken on line II—II of FIG. 1.

A preferred embodiment of the present invention is described hereinafter with reference to the accompanying drawings. FIGS. 1–10 show an embodiment of the present invention. FIG. 1 is a front view of the circuit breaker, and FIG. 2 is a cross-sectional view taken on line II—II of FIG. 1. In these figures, a case 1 comprises a base 1a and a cover 1b, and therein are provided a central pole 1A having an opening/closing mechanism and adjacent poles 1B and 1B having no opening/closing mechanism are provided are provided. A fixed conductor 2 of the power source side is fixed on the base 1*a*, and a fixed contact 3 is fixed on the fixed conductor 2.

A movable conductor 7 having a movable contact 6 thereon is pivotally mounted on a second contact arm 10*b* by a first pin 11. The movable conductor 7 is connected to an automatic trip device 4 via a flexible wire 8 and a connection bar 9. The automatic trip device 4 has therein a thermal-electromagnetic mechanism (not shown) or a solid-state trip device (not shown). A fixed conductor 5 of the load side is provided out of the automatic trip device 4.

A contact arm 10 comprises a first contact arm 10*a*, which is connected to an opening/closing operation mechanism described later, and a second contact arm 10*b*. Both contact arms 10*a* and 10*b* are pivotally held by a shaft 12. The first contact arm 10*a* of each pole is linked by a crossbar 13. A J-shaped aperture 14, which is long in an opening/closing direction of the movable contact 6, is formed on the first contact arm 10*a* and an oblong hole 15, which is long in a crossing direction against the opening/closing direction and catches a second pin 16 together with the J-shaped aperture 14, is formed on the second contact arm 10*b*. The second pin 16 is urged by a tension spring 17 to the first pin 11. A compression spring 18 is provided between the movable conductor 7 and the second contact arm 10*b* in order to provide a contact force to the movable contact 6.

Via a biasing force provided by tension spring 20*d*, an operation handle 19 is linked with the opening/closing operation mechanism 20 which comprises a cradle 20*a*, an upper link 20*b* and a lower link 20*c*, etc.. A stopper pin 21 is provided on the cradle 20*a*. The first contact arm 10*a* is connected with the lower link 20*c* by a connection pin 22. A trip relay mechanism 50 which comprises several mechanical parts is provided between the cradle 20*a* and a trip rod 32 of the automatic trip device 4.

Figure 3:
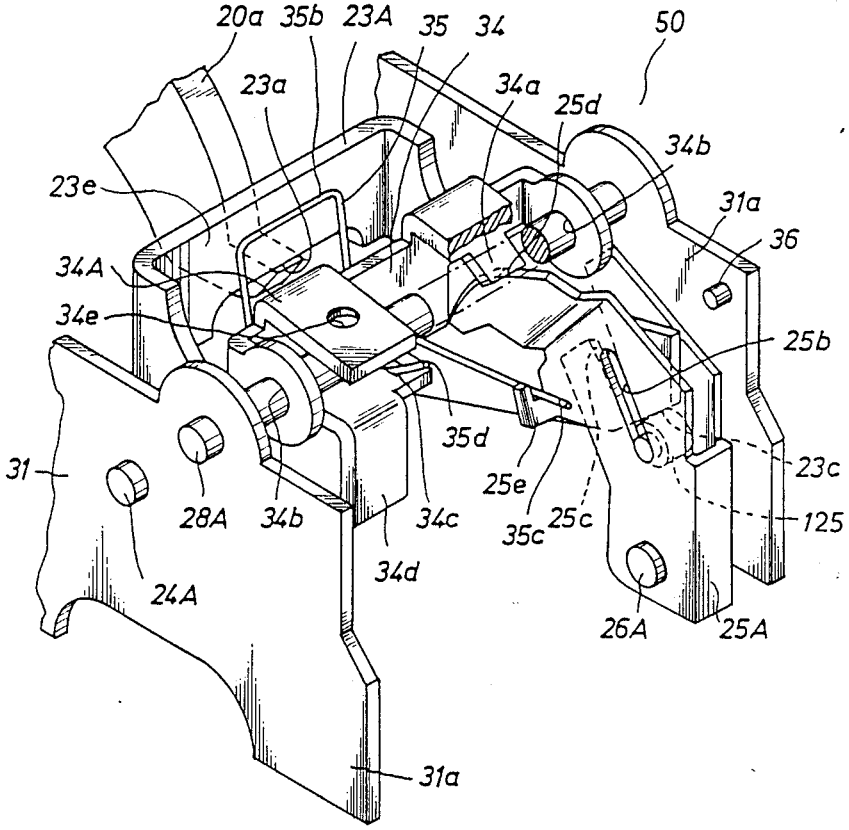
FIG. 3 is an enlarged perspective view showing a trip relay mechanism 50 of the preferred embodiment of the present invention.
Figure 4:
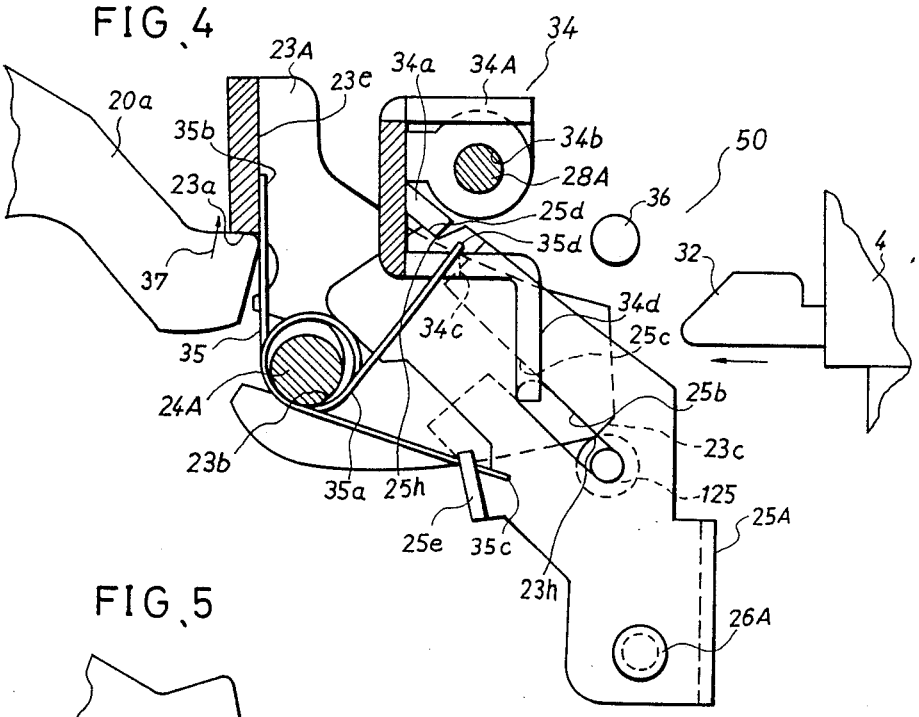
FIG. 4 is a cross-sectional view showing the trip relay mechanism 50 in a state before tripping of a circuit breaker between a cradle 20*a* and an automatic trip device 4.
Figure 5:
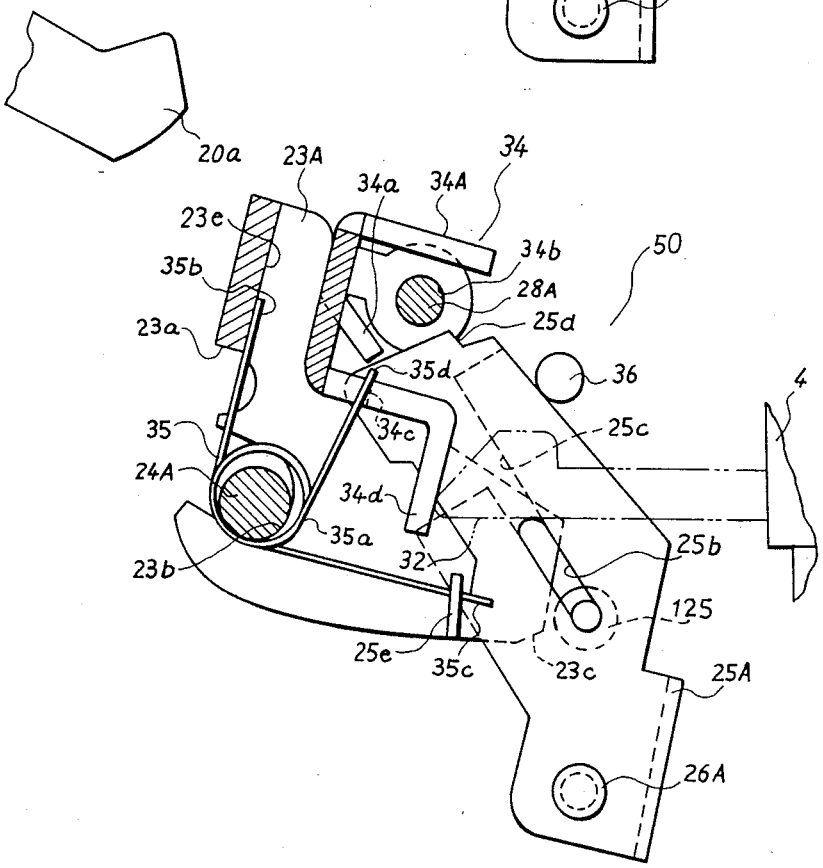
FIG. 5 is a cross-sectional view showing the trip relay mechanism 50 of a state just after tripping of a circuit breaker from the state shown in FIG. 4.

FIG. 3 is an enlarged perspective view of the trip relay mechanism 50, and FIGS. 4 and 5 are cross-sectional views of the trip relay mechanism 50.

Figure 6:
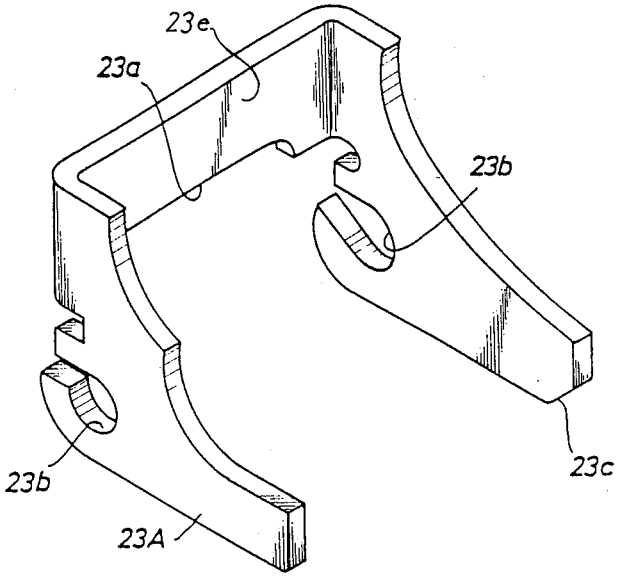
FIG. 6 is a perspective view showing a latch 23A of an embodiment of the present invention.
Figure 7:
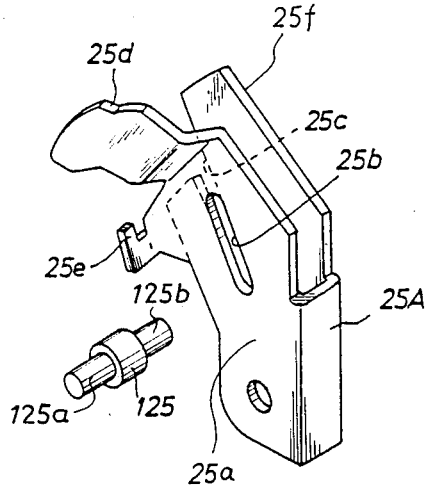
FIG. 7 is a perspective view showing a latch lever 25A of a preferred embodiment of the present invention.

In FIG. 3, a frame 31 comprising both side frames 31*a*and 31*a* is fixed on the base 1a (FIG. 2). A shaft 24A is held by the side frames 31*a* and 31*a*. A latch 23A is cradle-shaped as shown in FIG. 6 and has concavities 23*b*and 23*b* therein for holding the shaft 24A (FIG. 3) and an engaging part 23C on one arm thereof for engaging a roller 125 (FIG. 3). A latch lever 25A is fork-shaped with opposing side wings 25*a* and 25*f* as shown in FIG. 7. The side wings 25*a* and 25*f* have an oblong hole 25*b* and a cut-off part 25*c* for holding end portions 125*a* and 125*b* of the roller 125, respectively. Furthermore, the side wing 25*a* has an engaging part 25*d* for engaging a projection 34*a* of a trip bar 34 as best seen in (FIG. 3) and a hook 25*e* for hooking an end portion 35*c* of a double-torsion spring 35. In FIG. 3, the latch lever 25A is rotatably held by a pin 26A on the side frame 31*a*. A latching part 34A of the trip bar 34 comprises the projection 34*a* for preventing rotation of the latch lever 25A by the latch 23A, apertures 34*b* and 34*b*, a ditch 34*c* for catching another end portion 35d of the double-torsion spring 35 and an actuating part 34*d* to be pushed by the trip rod 32 (FIG. 2).

Figure 8:
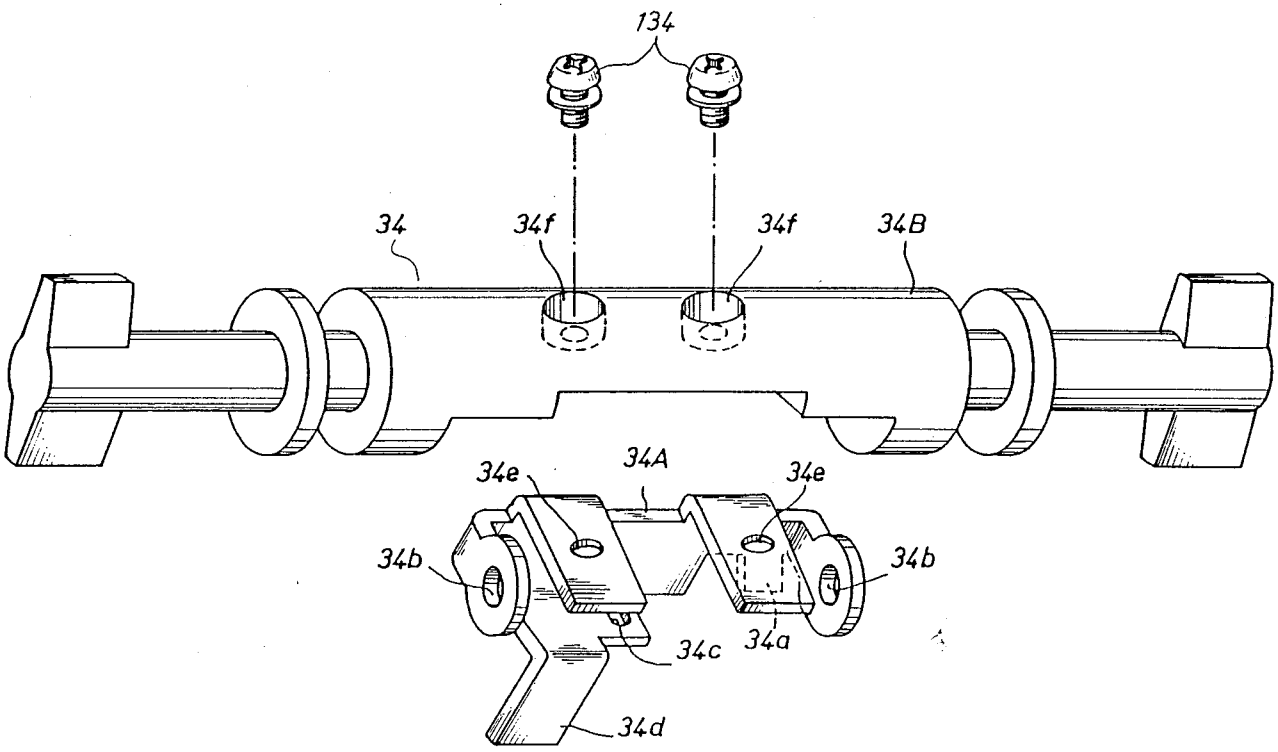
FIG. 8 is a perspective view showing a trip bar 34 of an embodiment of the present invention.

As shown in FIG. 8, the trip bar 34 comprises the latching part 34A, made of a pressed metal or nonmetal, and a main part 34B made of a molded resin, corresponding to respective required functions. This detachable construction of the trip bar 34 is advantageous to enable miniaturization and reduced cost thereof. When this trip bar 34 is assembled into the circuit breaker, first the latching part 34A is assembled in the frame 31 (FIG. 3) as a member of the trip relay mechanism 50 (FIG. 4); next, the frame 31 is fixed on the base 1*a* of the case 1; and, finally, the main part 34B which is extended over all poles 1B, 1A and 1B (FIG. 1) is fixed on the latching part 34A by screwing two screws 134 into two female screws 34*e* formed on the latching part 34A, through corresponding two holes 34*f* formed in the main part 34B. Thus, the main part 34B can be assembled in a final step of assembly of the circuit breaker. The main part 34B and the latching part 34A may be coupled by pressurizing each other.

Figure 9:
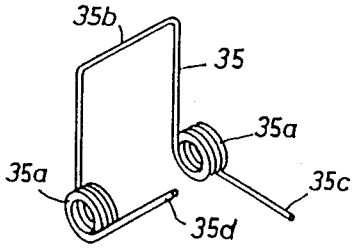
FIG. 9 is a perspective view showing a double-torsion spring 35 of an embodiment of the present invention.

FIG. 9 is a perspective view of the double-torsion spring 35. A pair of coiled portions 35*a*are inserted around the shaft 24A (FIG. 4), and a bridge portion 35*b* of the double-torsion spring 35 is engaged with an upper bosom portion 23*e* (FIG. 3, 4 or 6) of the latch 23A. In FIG. 4, the latch 23A is urged anti-clockwise by the bridge portion 35*b* so as to engage the latch 23A with the cradle 20*a*, and the latch lever 25A is urged anti-clockwise by the end portion 35*c* so as to engage the latch lever 25A with the latch 23A, and moreover the trip bar 34 (the latching part 34A) is urged anti-clockwise by the end portion 35*d* so as to engage the latching part 34A with the latch lever 25A. A stopper pin 36 is mounted on the side frame 31*a* (FIG. 3) in order to stop the rotation of the latch lever 25A.

Figure 14:
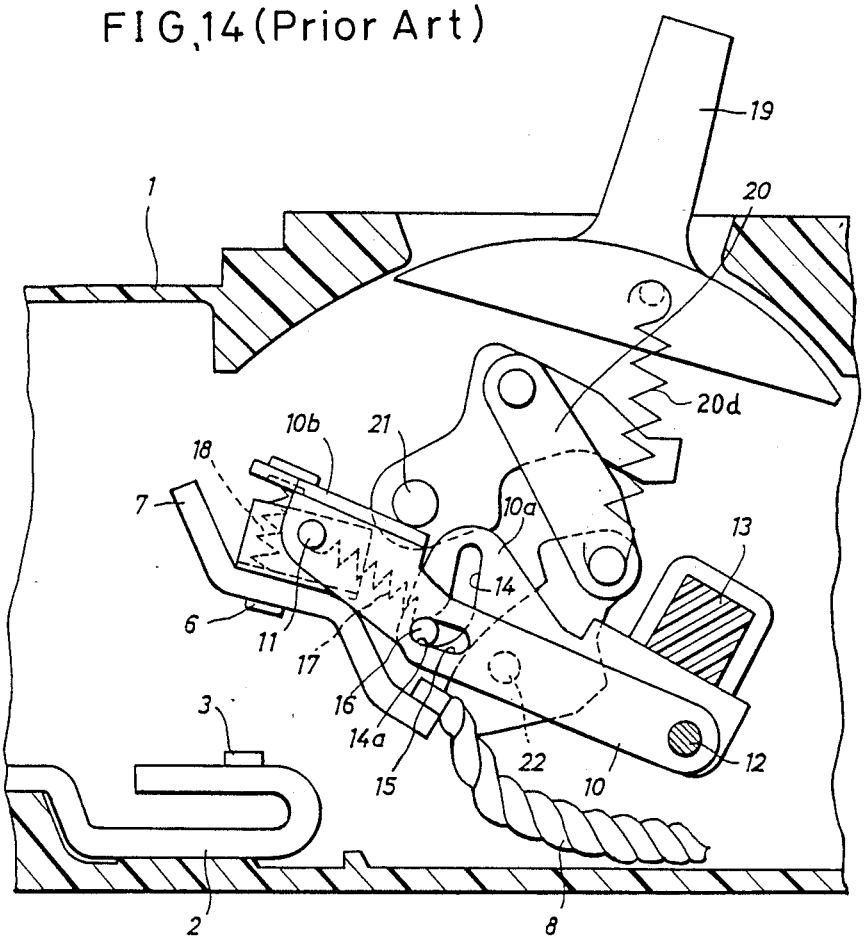
FIG.14 (Prior Art)
FIG. 14 is a partial enlarged view of FIG. 13 when the circuit breaker is open.
Figure 15:
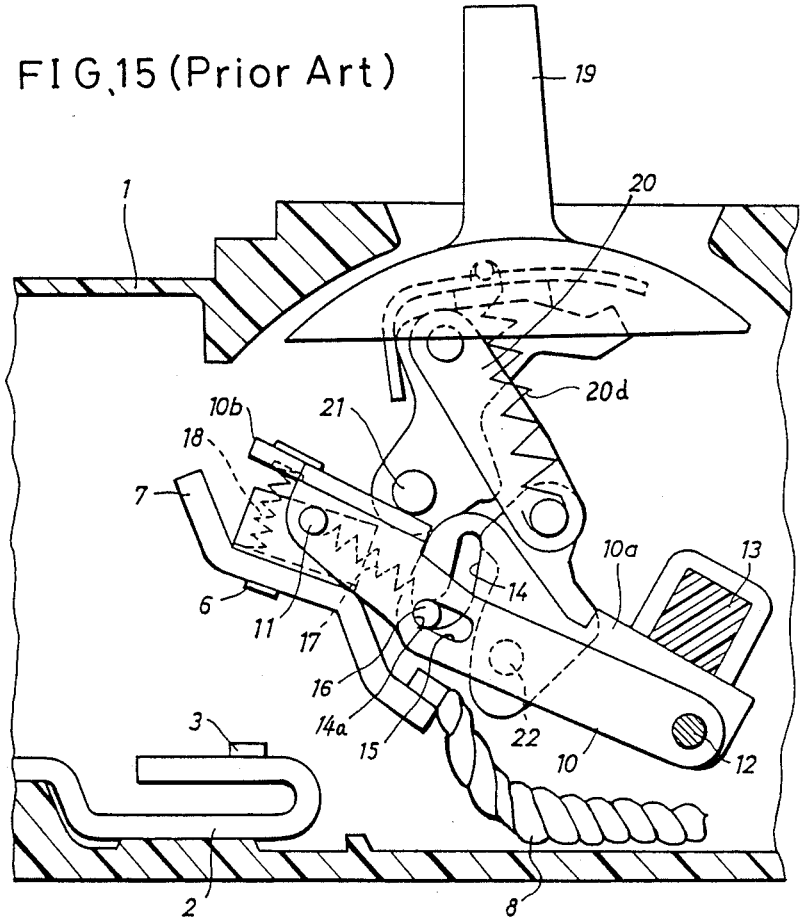
FIG.15 (Prior Art)
FIG. 15 is a partial enlarged view of FIG. 13 when the circuit breaker is tripped.
Figure 16:
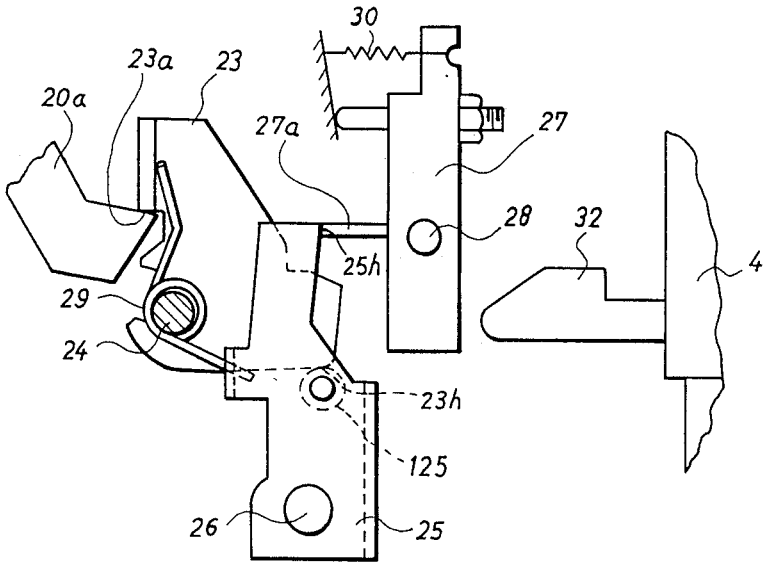
FIG. 16 (Prior Art)
FIG. 16 is a cross-sectional view showing the trip relay mechanism before tripping of the conventional circuit breaker between the cradle 20*a* and the automatic trip device 4.
Figure 17:
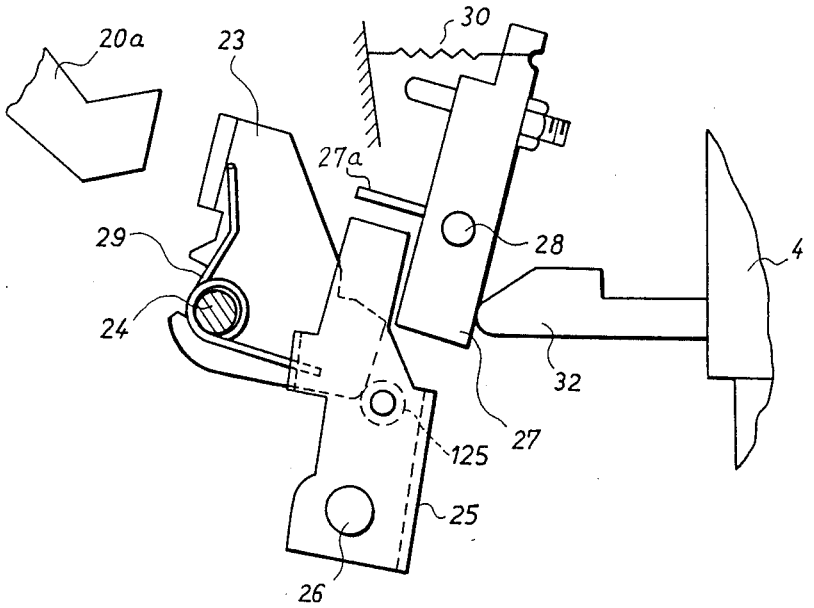
FIG. 17 (Prior Art)
FIG. 17 is a cross-sectional view showing the trip relay mechanism just after tripping of the conventional circuit breaker from the state shown in FIG. 16.

The, operation of this circuit breaker is now described. FIGS. 1, 2 and 4 show a closed state of the circuit breaker. In FIG. 2, a current flows through the fixed conductor 2 of the power source side, the fixed contact 3, the movable contact 6, the movable conductor 7, the flexible wire 8, the connection bar 9, the automatic trip device 4 and the fixed conductor 5 of the load side. When the operation handle 19 is moved to a direction shown by an arrow 33, to open the circuit breaker, the contact arm 10 is lifted up by the opening/closing operation mechanism, and thereby the movable contact 6 together with the movable conductor 7 are disconnected from the fixed contact 3 as shown in FIG. 14 (prior art). At that time, since the second pin 16 is caught in the left end 14a of the J-shaped aperture 14 under a biasing force of the tension spring 17, both the first contact arm 10*a* and the second contact arm 10*b* are pivotally lifted up by the opening/closing operation mechanism 20 around the shaft 12 until the second contact arm 10*b* collides with the stopper pin 21 and stops thereat. Under the closed state shown by FIG. 2 and an open state shown by FIG. 14, since the trip rod 32 is not projected out of the automatic trip device 4, the trip relay mechanism 50 (FIG. 2) maintains a state shown in FIG. 4 under a biasing force of the double-torsion spring 35 upon the latch 23A, the latch lever 25A and the trip bar 34, and thereby the cradle 20*a* is latched by the latch 23A.

When an overcurrent flows through the circuit breaker, the automatic trip device 4 operates and the trip rod 32 projects out of the automatic trip device 4 as shown in FIG. 5. Thereby, the latching part 34A of the trip bar 34 is rotated clockwise against the biasing force of the double-torsion spring 35, and the projection 34*a* of the latching part 34A is disengaged from the engaging part 25*d* of the latch lever 25A. Then, the latch lever 25A is allowed to rotate clockwise, and thereby the latch 23A is rotated clockwise by a lifting force 37 (FIG. 4) of the cradle 20*a* against the biasing force provided by the bridge portion 35*b* of the double-torsion spring 35; and, simultaneously, the latch lever 25A is rotated clockwise by the latch 23A against the urge by the end portion 35*c* of the double-torsion spring 35. Consequently, the trip relay mechanism 50 is instantaneously settled in a state shown by FIG. 5 and the cradle 20*a* jumps up to rotate anti-clockwise. Thereafter, the trip rod 32 immediately returns to the state as it was before, and thereby the latch 23A, the latch lever 25A and the latching part 34A of the trip bar 34 return to the state shown by FIG. 4 by receiving the biasing force of the double-torsion spring 35. Thereafter, when the operation handle 19 (FIG. 2) is operated by a resetting procedure, the cradle 20*a* is engaged with the latch 23A with a click.

In the above-mentioned circuit breaker, the latch 23A, the latch lever 25A and the latching part 34A of the trip bar 34 are disposed in a predetermined positional relationship in order to minimize a turning moment for disengagement of the latching part 34A, thereby to minimize the force required on the trip rod 32 to disengage the cradle 20*a*from the latch 23A. That is, in FIG. 4, predetermined intervals are secured between each fulcrum and each point of application about the latch 23A and the latch lever 25A, and, more specifically, between the engaging part 23*a*of the latch 23A and an axis of the pin 24A, between the axis of the shaft 24A and a contacting point 23*h*, between the contacting point 23*h* and an axis of the pin 26A and between the axis of the pin 26A and a contacting point 25*h*. Thereby, the cradle 20*a* which requires a comparatively large force to disengage itself from the latch 23A is disengaged from the latch 23A by actuating the actuation of part 34*d* of the trip bar 34 by means of the trip rod 32 with a small force. Since a center of rotation of the trip bar 34 (namely an axis of the shaft 28A) is disposed between a center of the latch 23A (namely the axis of the shaft 24A) and a center of the latch lever 25A (namely the axis of the pin 26A) in a power source side - load side direction, a length of the trip relay mechanism in that direction, hence a length of the circuit breaker in that direction, becomes shorter than that of the conventional circuit breaker.

Figure 10:
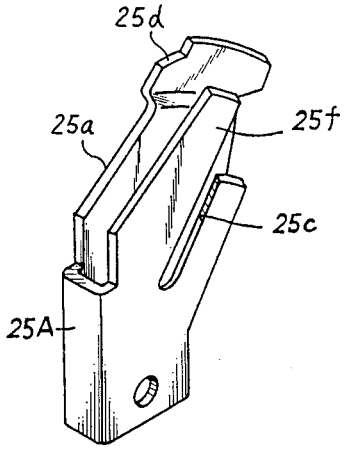
FIG. 10 is a reverse perspective view of FIG. 7.
Figure 11:
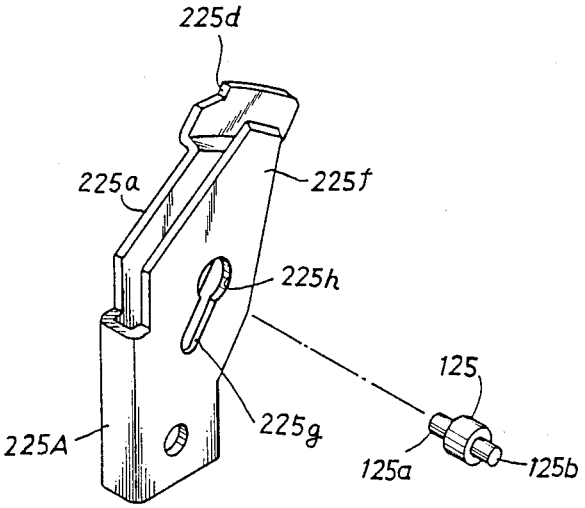
FIG. 11 is a perspective view showing a latch lever 225A and a roller 125 of another embodiment of the present invention.
Figure 12:
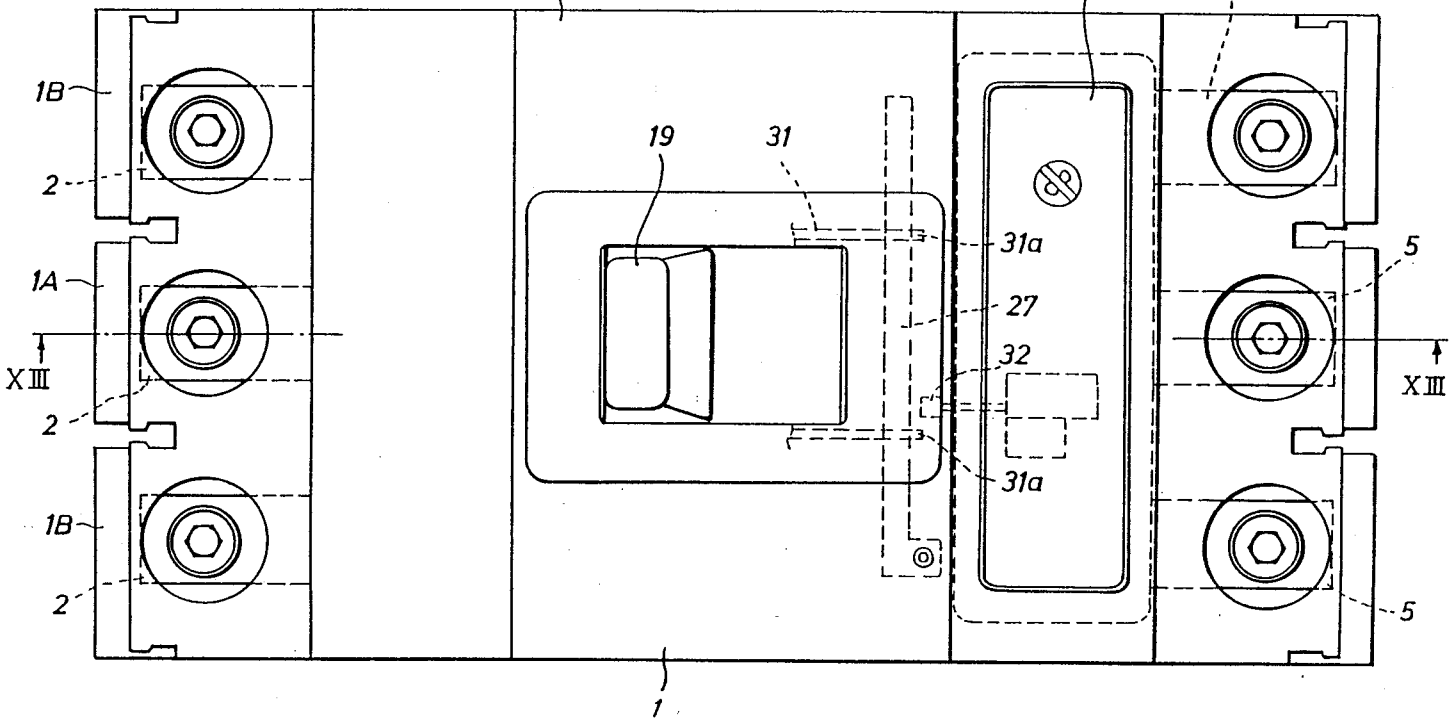
FIG.12 (Prior Art)
FIG. 12 is a front view showing the conventional circuit breaker.
Figure 13:
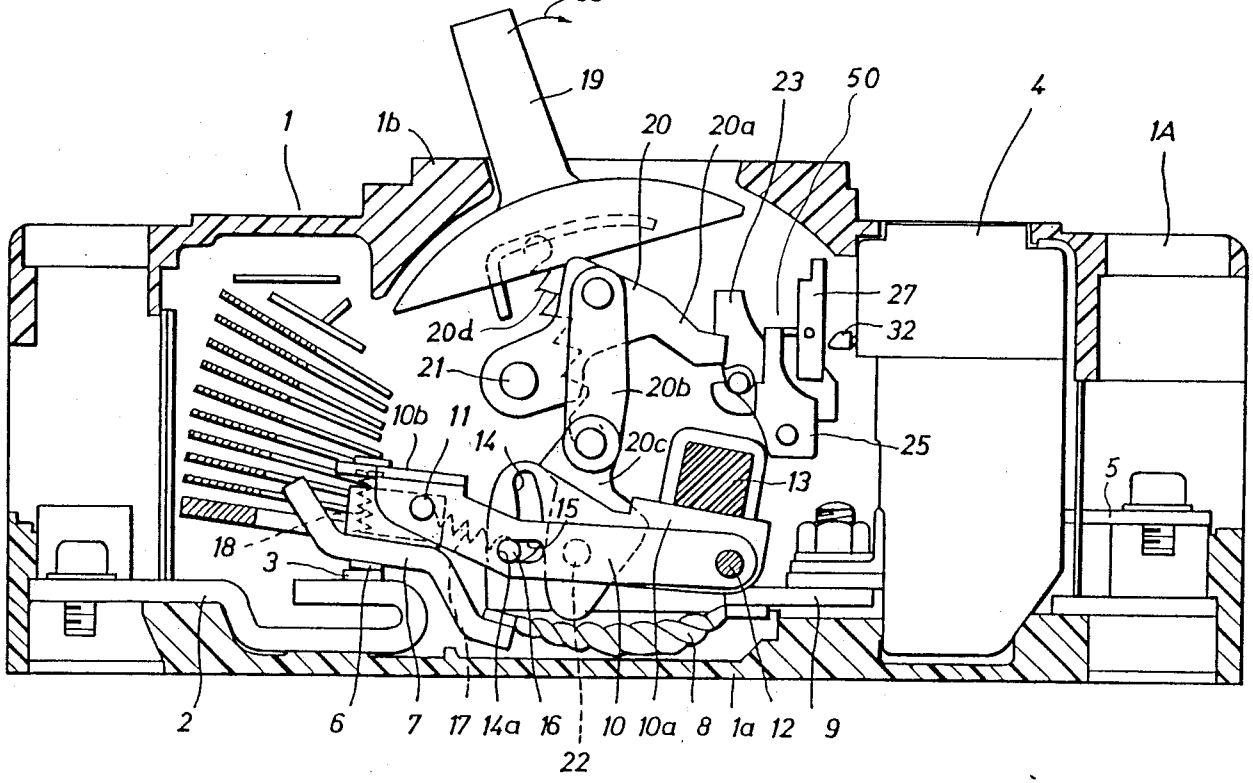
FIG. 13 (Prior Art)
FIG. 13 is a cross-sectional view taken on line XIII-XIII of FIG. 12.

FIG. 10 is a rear perspective view of the latch lever 25A. FIG. 11 is a rear perspective view showing another embodiment of the latch lever. In FIG. 11, the latch lever 225A has a side wing 225*f* wherein an oblong hole 225*g* for catching the end portion 125*b* of the roller 125 and a circle hole 225*h* which is connected to the oblong hole 225*g* for passing the roller 125 therein are formed. A reverse side wing 225*a* has the similar configuration to the side wing 25*a*of FIG. 7. Since the side wing 225*f* has no such cut-off part 25*c* as shown in FIG. 10, it is stronger than the side wing 25*f* against a mechanical shock given thereto. Therefore, there is no danger of side 225*f* deforming even when it collides with the stopper pin 36 (FIGS. 3–5). The circle hole 225h may, alternatively, formed in the reverse side wing 225a.

While specific embodiments of the invention have been illustrated and described herein, it is realized that other modifications and changes will occur to those skilled in the art. It is, therefore, to be understood that the appended claims are intended to cover all modifications and changes as fall within the true spirit and scope of the invention.

What is claimed is

1. A circuit breaker, comprising:

a case;

a fixed contact, fixedly mounted to said case;

a movable contact, which is pivotally mounted to said case and is movable to be connected with said fixed contact;

opening/closing operation means, which is pivotally mounted to said case for disconnecting/connecting said movable contact from/with said fixed contact and is biased to disconnect said movable contact from said fixed contact;

a latch, which is pivotally mounted to said case and is biased to engage with said opening/closing operation means;

a latch lever, which is pivotally mounted to said case is biased to engage with said latch;

a trip bar, which is pivotally mounted to said case and is biased to engage with said latch lever; and an automatic trip device for causing said trip bar to disengage from said latch lever when a current greater than a predetermined value flows through said circuit breaker thereby to cause said movable contact to disconnect from said fixed contact wherein a pivot of said trip bar is disposed between a pivot of said latch and a pivot of said latch lever, in a direction of power source side - load side of said case.

2. A circuit breaker in accordance with claim 1, wherein:

said trip bar comprises a main part extended over each pole of said circuit breaker and a latching part which is detachable connected with said main part for engaging with said latch lever.

3. A circuit breaker in accordance with claim 1, wherein:

said latch, said latch lever and said trip bar are biased by one double-torsion spring.

4. A circuit breaker in accordance with claim 1, wherein:

said latch is cradle-shaped and said latch lever is fork-shaped.

5. A circuit breaker in accordance with claim 1, wherein:

said latch lever comprises opposing two wings each having oblong holes, and roller held therein.

6. A circuit breaker, comprising:

a case;

a fixed contact, fixedly mounted to said case;

a movable contact, which is pivotally mounted to said case and is movable to be connected with said fixed contact;

opening/closing operation means, which is pivotally mounted to said case for disconnecting/connecting said movable contact from/with said fixed contact and is biased to disconnect said movable contact from said fixed contact;

a latch which is pivotally mounted to said case and is biased to engage with said opening/closing operation means;

a latch lever which is pivotally mounted to said case and is biased to engage with said latch;

a trip bar which is pivotally mounted to said case between said latch and said latch lever in a direction of power source side - load side of said case and is biased to engage with said latch lever;

a double-torsion spring which is mounted around a shaft of said latch and biases said latch, said latch lever and said trip bar; and an automatic trip device, for causing said trip bar to disengage from said latch lever when a current greater than a predetermined value flows through said circuit braker, thereby to cause said movable contact to disconnect form said fixed contact.

7. A circuit breaker, comprising:

a case;

a fixed contact, fixedly mounted to said case.

a movable contact, which is pivotally mounted to said case and is movable to be connected with said fixed contact; opening/closing operation means, which is pivotally mounted to said case for disconnecting/connecting said movable contact from/-with said fixed contact and is biased to disconnect said movable contact from said fixed contact;

a trip relay unit, comprising a latch which is pivotally mounted to said case and is biased to engage with said opening/closing operation means, a latch lever which is pivotally mounted to said case and is biased to engage with said latch, a trip bar which is pivotally mounted to said case at a location, between said latch and said latch lever in a direction of power source side - load side of said case and is biased to engage with said latch lever, and a double-torsion spring which biases said latch, said latch lever and said trip bar; and an automatic trip device, for causing said trip bar to disengage from said latch lever when a current of greater than a predetermined value flows through said circuit breaker, thereby to cause said movable contact to disconnect from said fixed contact.

* * * * *